US009370873B2

(12) United States Patent
Stichel et al.

(10) Patent No.: US 9,370,873 B2
(45) Date of Patent: Jun. 21, 2016

(54) MOLD FOR PRODUCING MOLDED CONCRETE BLOCKS

(75) Inventors: Holger Stichel, Pechtelsgruen (DE); Joerg Rasbieler, Zwickau (DE)

(73) Assignee: KOBRA Formen GmbH, Lengenfeld (DE)

( * ) Notice: Subject to any disclaimer, the term of this patent is extended or adjusted under 35 U.S.C. 154(b) by 500 days.

(21) Appl. No.: 13/884,068

(22) PCT Filed: Nov. 9, 2011

(86) PCT No.: PCT/EP2011/069774

§ 371 (c)(1),
(2), (4) Date: May 8, 2013

(87) PCT Pub. No.: WO2012/069315

PCT Pub. Date: May 31, 2012

(65) Prior Publication Data

US 2013/0234003 A1 Sep. 12, 2013

(30) Foreign Application Priority Data

Nov. 23, 2010 (DE) ..... 10 2010 060 742

(51) Int. Cl.
*B28B 7/16* (2006.01)
*B28B 7/24* (2006.01)

(52) U.S. Cl.
CPC ..... *B28B 7/162* (2013.01); *B28B 7/241* (2013.01)

(58) Field of Classification Search
CPC ..... B28B 7/162; B28B 7/241
USPC ..... 249/129, 130, 132, 133, 168
See application file for complete search history.

(56) References Cited

U.S. PATENT DOCUMENTS

| | | | | | |
|---|---|---|---|---|---|
| 699,856 | A * | 5/1902 | Stutz | F25C 1/24 | 249/126 |
| 796,939 | A * | 8/1905 | Schwerdtfeger | B28B 7/183 | 249/132 |
| 833,814 | A * | 10/1906 | White | B28B 7/241 | 249/122 |
| 862,521 | A * | 8/1907 | Street | B28B 7/241 | 249/129 |
| 1,158,973 | A * | 11/1915 | Bowen | B28B 7/241 | 249/129 |
| 1,402,084 | A * | 1/1922 | Musser | B28B 7/241 | 249/129 |
| 1,406,460 | A * | 2/1922 | Kinzinger | B28B 7/24 | 249/125 |
| 1,423,146 | A * | 7/1922 | Peckham | B41D 3/00 | 249/129 |
| 1,455,222 | A * | 5/1923 | Oswalt | B28B 7/241 | 249/123 |

(Continued)

FOREIGN PATENT DOCUMENTS

| | | |
|---|---|---|
| JP | 60 053512 | 4/1985 |
| JP | 60-53512 U | 4/1985 |
| WO | WO 2008/128993 | 10/2008 |

OTHER PUBLICATIONS

International Search Report of PCT/EP2011/069774, date of mailing May 30, 2012.

*Primary Examiner* — Yogendra Gupta
*Assistant Examiner* — Emmanuel S Luk
(74) *Attorney, Agent, or Firm* — Collard & Roe, P.C.

(57) ABSTRACT

The invention relates to a mold for producing molded concrete blocks with multiple molding cavities which are separated from one another by intersecting intermediate wall panels. The aim of the invention is an advantageous design of thintersection points of the intermediate wall panels with the additional lateral support of slot edges.

26 Claims, 6 Drawing Sheets

(56) References Cited

Figure 1:
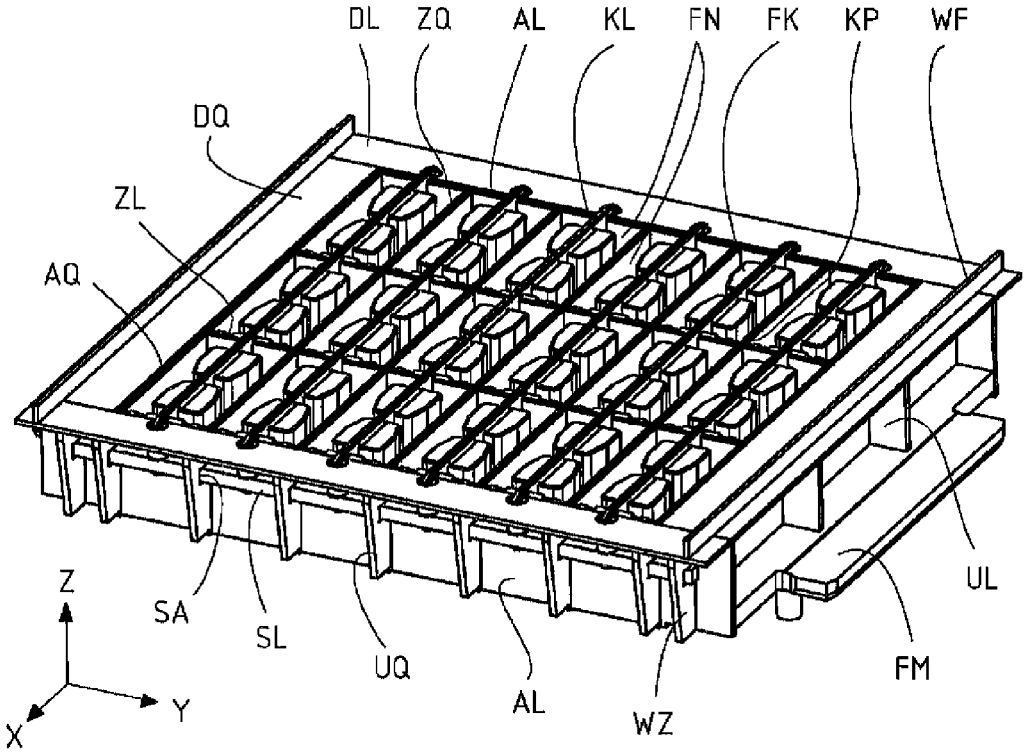

U.S. PATENT DOCUMENTS 1,481,473 A * 1/1924 Larson ..... B28B 7/241 249/127
1,512,905 A * 10/1924 Bunker ..... B28B 7/241 249/129
1,586,295 A * 5/1926 Weaver ..... B28B 7/241 249/126
1,756,146 A * 4/1930 Addison ..... B28B 7/241 249/129
1,817,544 A * 8/1931 Copeman ..... F25C 1/246 249/128
2,011,244 A * 8/1935 Hannaford ..... A23B 4/068 249/132
2,273,184 A * 2/1942 Elliott, Sr. ..... F25V 1/22 249/126
2,368,502 A * 1/1945 Troiel ..... B28B 7/0088 220/552
2,496,755 A * 2/1950 Schwartzberg ..... A23B 5/043 229/120.36
2,514,805 A * 7/1950 Seymour ..... B28B 7/02 249/163
2,854,724 A * 10/1958 Wuorio ..... B28B 7/02 217/30
4,090,918 A * 5/1978 Masetti ..... G21C 3/3563 165/162
4,249,358 A 2/1981 Thieffry
5,198,127 A * 3/1993 Tilley ..... A23G 3/0268 220/529
5,297,772 A * 3/1994 Stefanick ..... B28B 7/0014 249/102
5,743,510 A * 4/1998 Johnston ..... B28B 7/0014 249/155
5,866,026 A * 2/1999 Johnston ..... B28B 7/0014 249/119
7,014,161 B2 * 3/2006 Rampf ..... B28B 1/081 249/120
7,114,300 B1 * 10/2006 Culp ..... A47B 47/042 211/184
7,290,752 B2 * 11/2007 Keller ..... B28B 1/081 249/120
7,950,872 B2 * 5/2011 Radu, Jr. ..... E01F 1/00 249/160
8,012,391 B2 * 9/2011 Heerens ..... B28B 1/50 249/128
8,029,219 B2 * 10/2011 Toutant ..... B60P 7/0892 410/129
8,221,111 B2 * 7/2012 Sakai ..... B22C 9/00 117/213
8,458,980 B2 * 6/2013 Ivanov ..... A63H 33/084 446/105
2009/0127428 A1 * 5/2009 Hansen ..... B28B 7/366 249/122

* cited by examiner (B)

(C)

MOLD FOR PRODUCING MOLDED CONCRETE BLOCKS

CROSS REFERENCE TO RELATED APPLICATIONS

This application is the National Stage of PCT/EP2011/069774 filed on Nov. 9, 2011, which claims priority under 35 U.S.C. §119 of German Application No. 10 2010 060 742.8 filed on Nov. 23, 2010, the disclosure of which is incorporated by reference. The international application under PCT article 21(2) was not published in English.

The invention relates to a mold for the production of molded concrete blocks.

Molds for the industrial production of molded concrete blocks in concrete molding machines typically have a plurality of molding cavities disposed next to one another and separated from one another by means of partition walls. The totality of the molding cavities is also referred to as a block field, whereby the molding cavities standing at the edge, facing toward the outside of the block field, are delimited by outside walls. For high molds, in particular, for example for the production of hollow blocks, at least the partition walls are typically formed from wall panels that are connected with one another and with the outside walls, directly or indirectly, and form an essentially rigid box. The molding cavities are open toward the top and toward the bottom, and the wall panels are configured to be continuous vertically between an upper and a lower delimitation plane of the mold. At the top of the mold, the block field is generally surrounded by a cover frame surface, which can particularly be formed by means of replaceable metal sheets that wear away.

The wall surfaces that delimit the molding cavities are exposed to significant mechanical stresses, particularly statically as the result of the high lateral pressure of the concrete mixture, against the top of which pressure plates are applied, and dynamically as the result of friction wear forces of the grainy components of the concrete mixture that are moved along the wall surfaces during shaking and unmolding. To reduce the wear phenomena resulting from friction, the surfaces of the side wall are advantageously hardened. For hardening, case hardening yields greater wear resistance than nitriding, but also brings with it a greater risk that molds will be distorted and must be reworked after hardening, with great effort.

While the connections of the partition walls with the outside walls can be carried out in shape-stable and relatively simple manner in the case of molds in which partition walls run only in one direction between opposite outside walls, this is significantly more difficult in the case of molds having partition walls that run in different directions and intersect at intersection points.

Weld connections of the wall panels at intersection points produce stable connections, but weaken the wear resistance if welding occurs after hardening, and increase the permanent fracture risk. Molds having wall panels welded before hardening frequently demonstrate great distortion after hardening.

Weld-free connections can be produced, for example, in that the partition walls are structured, in a first direction, as first wall panels that are continuous over the entire block field, and that partition walls that run in a second direction, transverse to the first, run only between two first wall panels, and are connected with the first wall panels with shape fit, by way of push-in connections on their face surfaces that face the first wall panels. U.S. Pat. No. 4,249,358 describes molds having intersecting wall panels as partition walls and outside walls of molding cavities of a block field, which are inserted into one another in comb-like manner at intersection points, by way of slots oriented in opposite directions, and are attached to a mold frame, outside of the block field, in weld-free manner.

The invention is based on the task of indicating an advantageous structure of a mold having wall panels that intersect at intersection points.

The invention is described in the independent claim. The dependent claims contain advantageous embodiments and further developments of the invention.

By means of the shape-fit fixation of the edges of a slot of a partition wall panel by means of holding structures on the other partition wall panel of an intersection point, transverse support with great stability of the push-in connection of two partition wall panels that exists at the intersection point is advantageously obtained. In particular, lateral deviation of the wall panels from the vertical progression in the region of the opening of the slot, for example under the effect of the hydrostatic pressure in the concrete mixture, can be reduced.

In this connection and below, the information top, bottom, vertical, horizontal, etc. relates to a regular operating position of the mold in a molding machine, in which the mold rests on a horizontal, level bottom support with a lower delimitation plane, and the molding cavities possess an essentially uniform cross-section in the vertical direction.

By means of the shape-fit fixation, slight shape distortions of the partition wall panels that might occur as the result of a prior hardening process can also advantageously be balanced out again. It is advantageous if the holding structures are configured as depressions, particularly as grooves in the wall surface of a first one of the two wall panels inserted into one another at the intersection point, in which the edges of the slot of the second of the two wall panels are supported.

Transverse support of the edges of the slot, which is open toward the bottom, is particularly important. Preferably, the edges of the slots of both partition wall panels that are inserted into one another so as to intersect are fixed in place on holding structures of the other partition wall panel, in each instance, and support to prevent a position change parallel to the wall surface of the wall surface that has the holding structures.

Depressions structured as grooves, in an extension of the first slot, are configured as holding structures in the wall surface of a first partition wall panel, advantageously extending over the entire expanse of the first partition wall panel, as an extension of the first slot, so that the edges of the second slot lie in the first grooves over the entire length of the latter, and are fixed in place with shape fit. In a particular further development, the engagement depth of the edges of the second slot into the first grooves can be greater in an initial region that lies at the opening of the second slot than in a region that is spaced apart from the slot opening. For this purpose, the first grooves can preferably have a constant cross-section over their vertical longitudinal expanse, and the edges of the second slot can have projections that face one another, in the initial region. In the region spaced apart from the slot opening, a slot edge then has a greater distance from the bottom of the groove than in the initial region. In particular, the projections can also lie firmly against the groove bottoms, without making it significantly more difficult to put the partition wall panels together at the intersection point.

It is advantageous if the outside walls of the molding cavities of the block field are also delimited by wall panels, referred to hereinafter as outside wall panels. The partition wall panels can preferably also be connected, at intersection points with partition wall panels and/or other outside wall panels, in weld-free manner, by way of comb-like slot push-in connections. At these intersection points, other connection forms can also exist. Relative fixation of outside wall panels to one another and to the partition wall panels preferably takes place outside of the block field, for which purpose the partition wall panels advantageously project laterally beyond the outside wall panels with projections. In this connection, it is also advantageous if no welds are performed on panel sections that delimit the molding cavities. In particular, connection elements can be disposed on outside surfaces of the outside wall panels and/or partition wall panels, which elements bring about relative vertical fixation of partition wall panels and outside wall panels.

In a particular embodiment, additional panels, essentially parallel to the outside wall panels, can be additionally provided on two opposite sides of a block field, at a distance from the outside wall panels that delimit this block field and at a distance from it, which panels form empty fields with the outside wall panels and the partition wall panels that run in intersecting manner. Because of the distance from the block field, weld connections with the intersecting partition wall panels can be produced on the additional panels, without impairing the wear resistance of the hardened wall surfaces of the molding cavities.

It is advantageous if the mold has an essentially rectangular outline, seen in a top view, delimited by longitudinal sides and transverse sides, and flanges for clamping the mold into a molding machine on the two transverse sides, but not on the longitudinal sides, by means of which flanges the mold can be pressed against the shakable bottom support, with great force, during filling of the molding cavities and during a shaking process for compaction of the concrete mixture to form molded concrete blocks. While in the case of U.S. Pat. No. 4,249,358 mentioned initially, the greatest force stress is assumed to occur during lifting of the mold when the molded concrete blocks are unmolded, the maximal stresses that occur in the case of a mold adapted to a shakable bottom support are those that occur during the shaking process, whereby in particular, the bottom support exerts forces that are directed upward, on the lower edges of the wall panels of the mold, and the machine clamping exerts forces directed downward, on the flanges on the transverse sides. It is advantageous if the slot openings of the continuous partition wall panels between the two transverse sides, which are particularly subject to stress caused by bending during this process, face downward, so that narrowing of the slot opening connected with bending of these partition wall panels can be particularly advantageously absorbed by means of supporting the slot edges on the wall panels that run transversely, and bending can be kept particularly slight. It is advantageous if the length of the slots that face downward amounts to not more than 45%, particularly not more than 40% of the total height of the partition wall panels. In the partition wall panels that run transverse to them, the length of the slots that are open toward the top then amounts to at least 55%, particularly at least 60% of the total height of the partition wall panels.

The invention will be discussed in detail below, using preferred exemplary embodiments and making reference to the figures.

Figure 2:
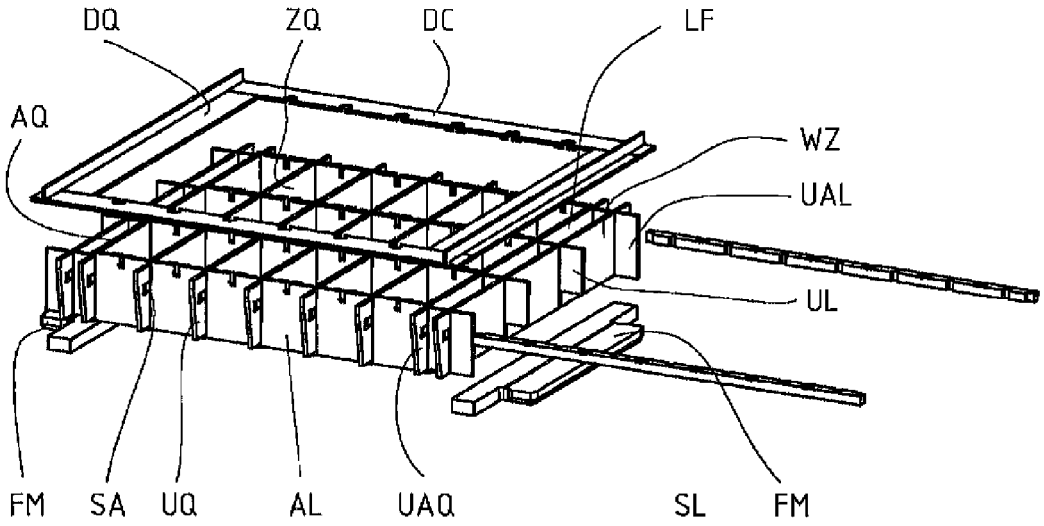

These show:

FIG. 1 a complete mold in a slanted view,

FIG. 2 an assembly representation of components of the mold according to FIG. 1, FIG. 3 the wall panels of the mold according to FIG. 1 in an assembly position, FIG. 4 two wall panels inserted into one another, FIG. 5 a longitudinal wall panel in different views, FIG. 6 a transverse wall panel, FIG. 7 an enlarged detail of a slot, FIG. 8 the representation according to FIG. 7 with a view parallel to the wall panel normal line, FIG. 9 a view into the slot from below, FIG. 10 a slanted view of a slot that is open toward the top, FIG. 11 a sectional representation of a detail of an intersection point, FIG. 12 an intersection point from below, FIG. 13 an intersection point from above, FIG. 14 an enlarged representation of a slot end region, FIG. 15 an enlarged representation of a support region, FIG. 16 a variant of a mold structure, FIG. 17 a detail of FIG. 16.

FIG. 1 shows a complete mold for the production of hollow blocks, at a slant from above; this mold will be used to explain the invention below. A right-angle x-y-z coordinate system, the x-y plane of which runs horizontally in the regular operating position of the mold, and the z direction of which indicates the vertical direction in this connection, is also shown in the drawing. In the following, the x direction will also be referred to as the transverse direction, and the y direction as the longitudinal direction.

The mold has a plurality of molding cavities FN, which run continuously between an upper horizontal delimitation plane that can be seen in FIG. 1 and a lower horizontal delimitation plane that is covered in FIG. 1, at an essentially uniform cross-section, and are open toward the top and toward the bottom. In operation, the mold is set onto a shakable bottom support of a molding machine with the lower delimitation plane, and clamped into a molding machine by way of two machine flanges FM disposed on transverse sides that lie opposite one another in the longitudinal direction y, and pressed down against the shakable bottom support. For filling the molding cavities FN with flowable fresh concrete mixture, a filling carriage is typically moved over the mold in the x direction. Dirt strips or guide strips WF can be provided at the top of the mold.

The totality of the multiple molding cavities FN forms the block field, which is delimited toward the outside by longitudinal outside walls AL that run in the longitudinal direction y, and by transverse outside walls AQ that run in the transverse direction x. The outside walls AL, AQ are advantageously formed by wall panels.

The molding cavity is divided into the multiple molding cavities by means of longitudinal partition walls ZL that run in the longitudinal direction y, and by means of transverse partition walls ZQ that run in the transverse direction x. The partition walls intersect at intersection points KP and are inserted into one another there in a manner that will be described in greater detail below, and held against one another in weld-free manner.

The partition walls ZL, ZQ are also structured as wall panels and pass through the block field without interruption, in the longitudinal direction or the transverse direction, between the outside walls AL or AQ, respectively. At the intersection points, the partition wall panels ZQ, ZL are supported horizontally against one another. Vertical fixation between wall panels that run in the longitudinal direction and the transverse direction advantageously takes place by means of connection devices outside of the block field, for which purpose a clamping strip SL shown in the longitudinal direction is shown in FIG. 1, which strip is passed through recesses SA in panel projections UQ of the transverse partition wall panels that project beyond the longitudinal outside wall panels AL.

Molding cores FK are disposed in the molding cavities FN, which cores are held on core holder strips KL that span the block field.

In the longitudinal direction y of the transverse outside wall panels AQ, offset away from the block field, additional wall panels WZ are provided in the example shown in FIG. 1, which panels run parallel to the transverse outside wall panels AQ and form empty fields on the transverse sides that lie opposite one another in the longitudinal direction y, outside of the block field. The longitudinal partition walls ZL that run in the longitudinal direction y also run intersecting with these additional wall panels WZ, and project beyond the additional wall panels WZ with panel sections UL, in the longitudinal direction. At the top of the mold, metal cover sheets DL that run in the longitudinal direction and metal cover sheets DQ that run in the transverse direction are provided, which are typically connected with the mold in releasable manner, as wear parts.

The machine flanges FM are advantageously connected with the panel ends of the partition wall panels ZL and outside wall panels AL that run in the longitudinal direction, in order to transfer the forces of the molding machine to the mold. No machine flanges are affixed on the longitudinal sides of the mold. When the mold is pressed down onto the shakable bottom support, by way of the machine flanges FM clamped into the molding machine, the mold is therefore subject, in particular, to bending in y-z planes.

FIG. 2 shows components of the mold shown in FIG. 1, in an assembly representation. For the sake of clarity, the molding cores FK and the core holder strips KL are not shown in FIG. 2. In FIG. 2, the wall panels that run in the longitudinal direction and transverse direction are shown in the state in which they are still inserted into one another.

Figure 3:
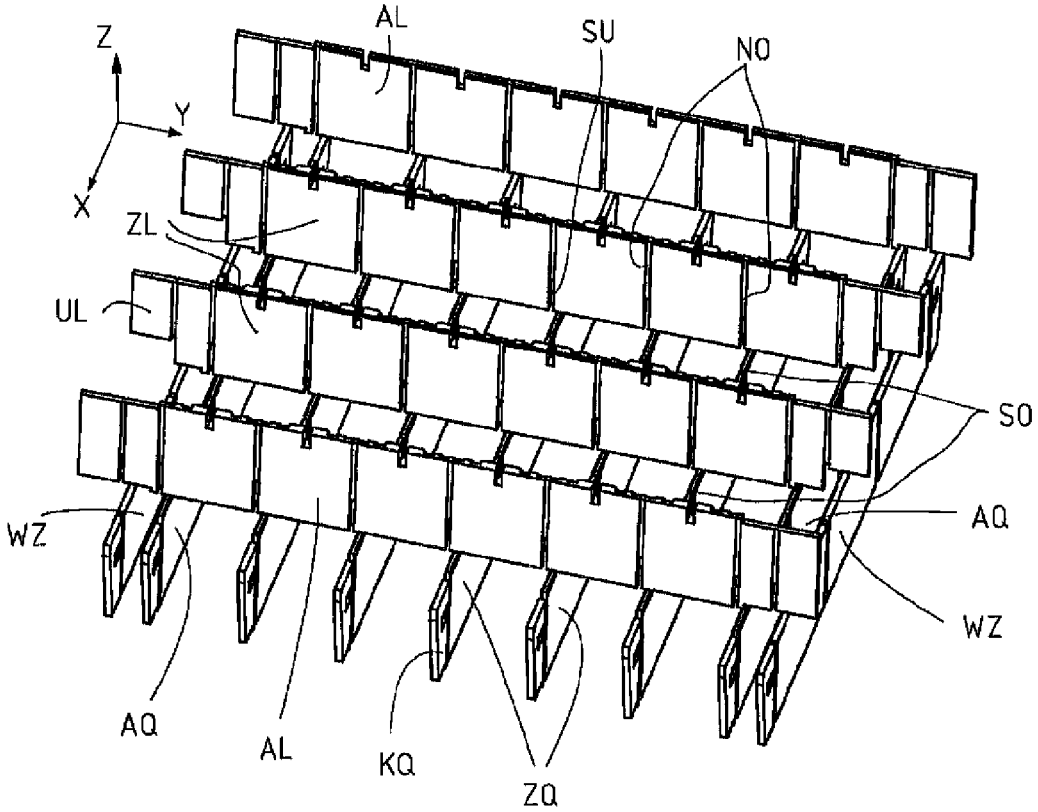

FIG. 3 exclusively shows the wall panels used in the mold according to FIG. 1 and FIG. 2, in a representation in which they are released from one another but aligned for joining. The longitudinal partition wall panels ZL and one of the longitudinal outside wall panels AL have a non-planar structure on one side, which produces depressions in side surfaces of a hollow block, into which mortar or adhesive can be introduced in order to connect adjacent blocks. For the remainder, the wall panels are essentially planar and advantageously of at least approximately the same thickness, which promotes uniform and distortion-free hardening in a common hardening process. Planarity of the panels is not compulsory, but is particularly advantageous with regard to production, and is usual for a great number of block shapes. In the following, the point of departure is therefore molds having wall panels that run straight in the longitudinal direction and the transverse direction, without any restriction of generality.

The longitudinal partition wall panels ZL have lower slots SU that lead upward from their bottom edges UK, and in the transverse partition wall panels ZQ, slots SO are conducted, in corresponding manner, downward from the top edges of these transverse partition wall panels. Corresponding slots are also configured in the outside wall panels AL, AQ, and the additional wall panels WZ. The longitudinal and transverse panels that run intersecting one another in vertical projection are inserted into one another with lower slots SU and upper slots SO that align in the vertical direction. The slots then lie at the intersection points of the assembled panels.

Figure 4:
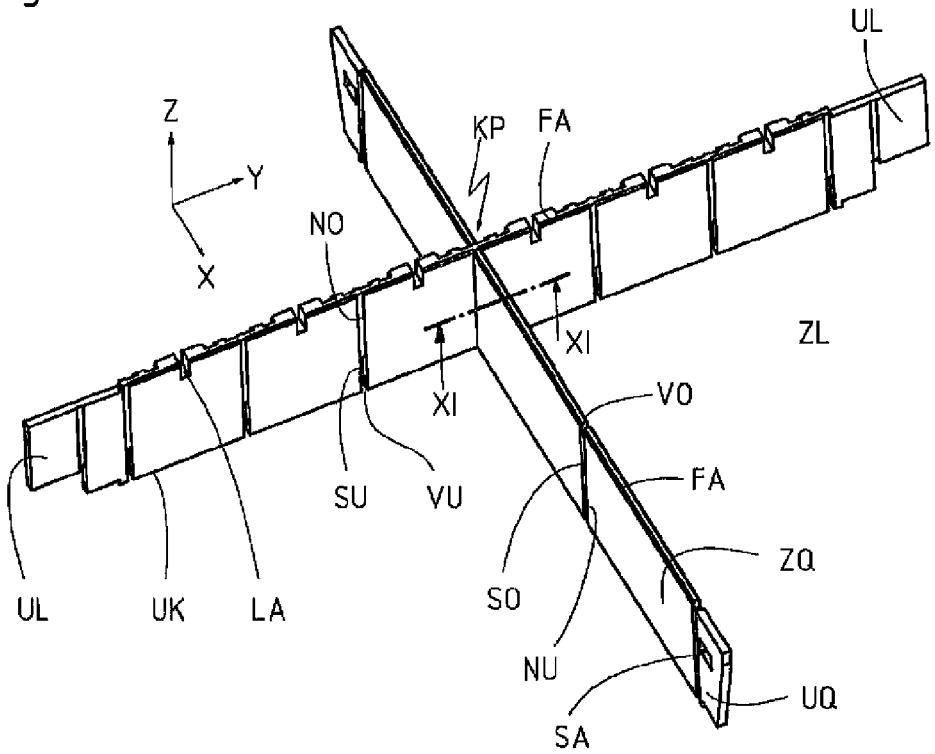

FIG. 4, for a further illustration of the invention, shows only one longitudinal partition wall ZL and one transverse partition wall ZQ, which are inserted into one another at an intersection point KP, so that the lower edges of the two wall panels lie in a common lower delimitation plane. The push-in connection of the two wall panels at the intersection point KP guarantees that the two wall panels are supported on one another not only in the longitudinal direction y but also in the transverse direction x.

It is essential to the invention that not only does lateral engagement of the longitudinal partition wall ZL through a slot SO of the transverse partition wall ZQ and engagement of the transverse partition wall ZQ through a slot SU of the longitudinal partition wall ZL exist, but also, in addition, the slot edges of at least one slot SU or SO, preferably of both slots, are additionally supported in the horizontal direction, parallel to the surrounding wall panel, by means of holding structures on the wall panel around which the slot engages, in each instance. The edges of a slot SO of the transverse partition wall ZQ that is open toward the top are thereby additionally supported in the y direction at the intersection point KP, so that no bending, particularly of the top edge of the transverse partition wall ZQ, can occur in the region of the slot opening. In the same manner, the edges of a slot SU of the longitudinal partition wall ZL that is open toward the bottom is supported, at the intersection point KP, on the transverse partition wall ZQ by means of holding structures, at the intersection point, to prevent a displacement that might be possible in the event of deformation of the longitudinal partition wall ZL, particularly of the lower edge UK of the longitudinal partition wall.

In a preferred embodiment, as shown in FIG. 4, such holding structures are implemented on the wall panels by means of grooves that form an extension of the slots. In an extension of the slots SU in the longitudinal partition wall ZL that are open toward the bottom, upper grooves NO are configured as depressions relative to the surrounding panel surface. Slot edges of a slot SO of the transverse partition wall ZQ that is open toward the top lie in these upper grooves NO at an intersection point KP, and thereby prevent deviation of the top edges of the transverse partition wall ZQ, in particular, at the intersection point KP, in the y direction, when great forces occur. In the same manner, lower grooves NU are provided in the transverse partition wall ZQ, as an extension of a slot SO that is open toward the top, and edges of a lower slot SU of the longitudinal partition wall ZL are supported in lower grooves NU of the transverse partition wall ZQ, to prevent deviation in the x direction.

Support is particularly important at the slot openings, in each instance, because the wall panels are exposed to the greatest bending moments here, in the case of forces that might act on the wall panels unequally from panel sides that lie opposite one another. The slots are therefore advantageously narrowed by a slight dimension in the region of their openings, as compared with the remainder of their course. In the lower slots SU, projections VU are configured in the region of the slot opening on the lower edge UK of the longitudinal partition wall, and in the upper slots SO, projections VO are configured in the transverse partition wall; these projections narrow the slot width slightly as compared with the remaining course of the slot. Such a particular configuration of the slots is particularly advantageous for transverse support of the particularly stressed panel edges in the region of the slot openings, on the one hand, and for simple assembly of intersecting panels at the intersection points, on the other hand.

It is furthermore particularly advantageous that, in connection with the fastening of machine flanges FM to the ends of the longitudinal partition wall panels ZL that lie opposite one another in the longitudinal direction y, the slots in the longitudinal partition wall panels ZL are open toward the bottom. Because of the holding forces that are directed downward on the machine flanges FM at the ends of the longitudinal partition wall panels, and because of the forces that are directed upward on the lower edges UK of the wall panels during the shaking process, the longitudinal partition wall panels are exposed to bending stresses that attempt to bring about upward arching of the longitudinal partition wall panels between the machine flanges FM. In this connection, the lower slots would be narrowed, but because of the support of the groove edges of the slower slots SU in the lower grooves NU of the transverse partition wall panel in the y direction, this is prevented, to a great extent, so that as a result of this selection of the orientation of the slot openings in the longitudinal partition wall panels downward, the bending rigidity of these panels against the particular bending stresses in the molding machine during shaking operation is increased. The transverse partition wall panels ZQ are not exposed to any noteworthy bending stresses, because no particular holding-down forces that go beyond the inherent rigidity of the mold act on the opposite ends of these transverse partition wall panels.

The particular and different bending stresses of the longitudinal partition wall panels and the transverse partition wall panels having the machine flanges exclusively at the opposite ends of the longitudinal partition wall panels is also advantageously taken into account in that the slot length of the lower slots SU in the longitudinal partition wall panels is less than the length of the upper slots SO in the transverse partition wall panels.

Figure 5:
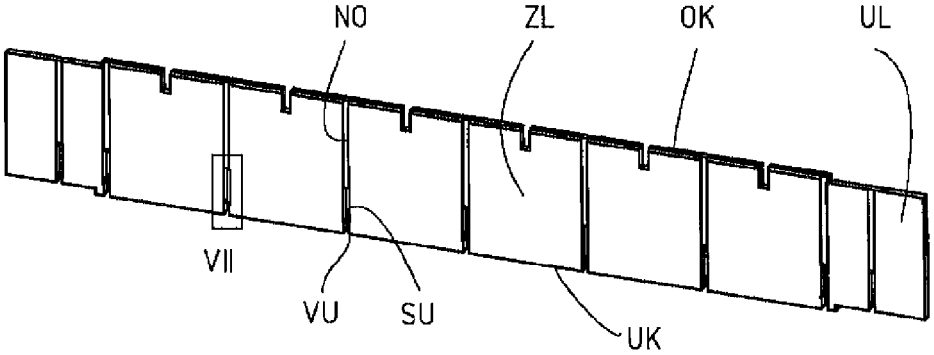
Figure 5:
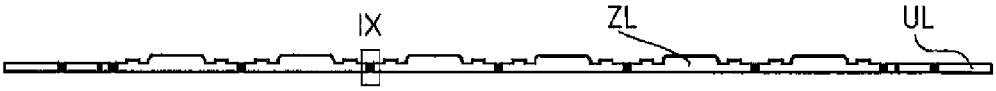
Figure 5:
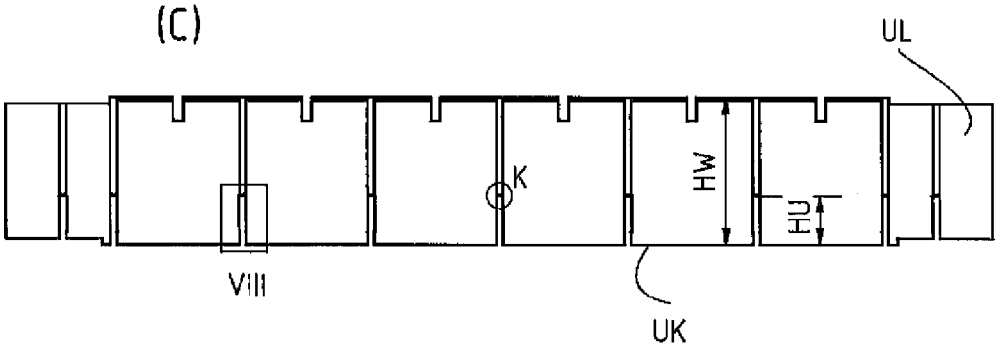

In FIG. 5, a longitudinal partition wall panel ZL is shown individually, in different views, whereby FIG. 5(A) shows a slanted view, FIG. 5(B) shows a view from below of the lower edge, and FIG. 5(C) shows a view in the x direction, perpendicular to the panel surface. The individual design characteristics of the longitudinal partition wall panel ZL are provided with the reference symbols that have already been used in FIG. 4, so that reference is made to the explanations regarding FIG. 4. In FIG. 5, regions that are shown enlarged in FIG. 7, FIG. 8, and FIG. 9 are indicated with Roman numbers VII, VIII, and TX.

Figure 6:
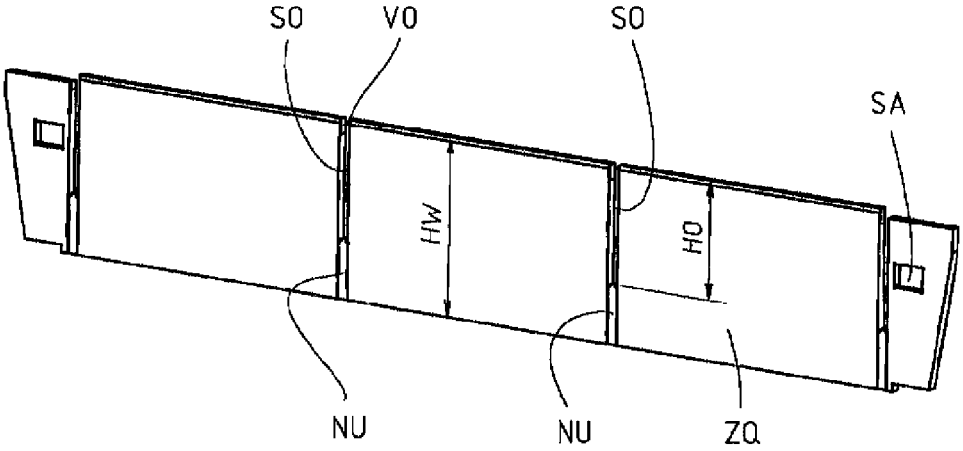

FIG. 6 shows, in a slanted view, an individual transverse partition wall panel ZQ, in which the slot length of the upper slot SO is indicated with HO. The slot length HO advantageously amounts to at least 55%, particularly at least 60% of the total height HW of the wall panel. The other reference symbols used in FIG. 6 are identical, in their identification, with the reference symbols used in the preceding figures, to which reference is made for this purpose.

Figure 7:
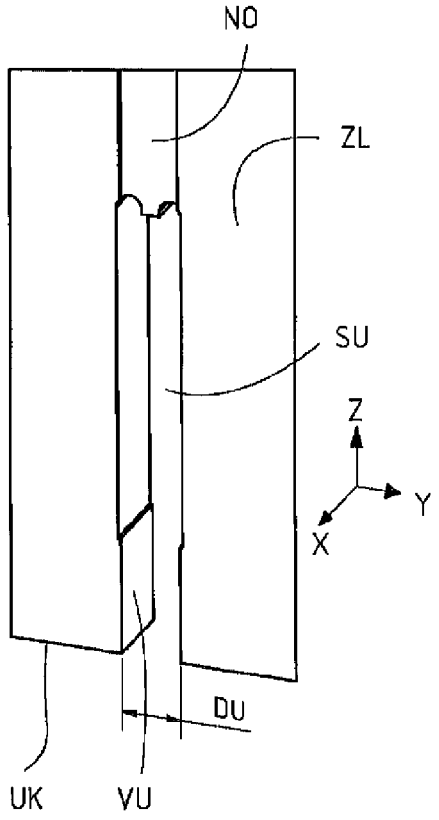

FIG. 7 shows, as a detail VII of FIG. 5(A), in a slanted view, a lower slot SU in a longitudinal partition wall panel ZL. FIG. 8 shows the detail with a viewing direction parallel to the x direction. The lower slot SU is open toward the lower edge UK of the wall panel. In the region of the slot opening, the slot width, measured in the y direction, is reduced to a width dimension DU by means of projections VU that lie opposite one another. The dimension DU is coordinated with the reduced wall thickness of the lower groove NU of the transverse partition wall panel. In a region spaced apart from the lower slot opening, the slot SU is structured to be wider by a slight dimension. In the z direction, as an extension of the slot SU, an upper groove NO is configured as a depression in the wall surface of the longitudinal partition wall panel, as a holding structure for the slot edges of a transverse partition wall panel assembled to the longitudinal partition wall panel ZL at an intersection point. The width of the groove NO in the y direction is preferably essentially equal to the projection distance DU. The width BO of the groove NO is coordinated with the width of the upper projections VO at the opening of the slot SO that is open toward the top, which width is reduced as compared with the surrounding wall thickness of the transverse partition wall panel.

Figure 8:
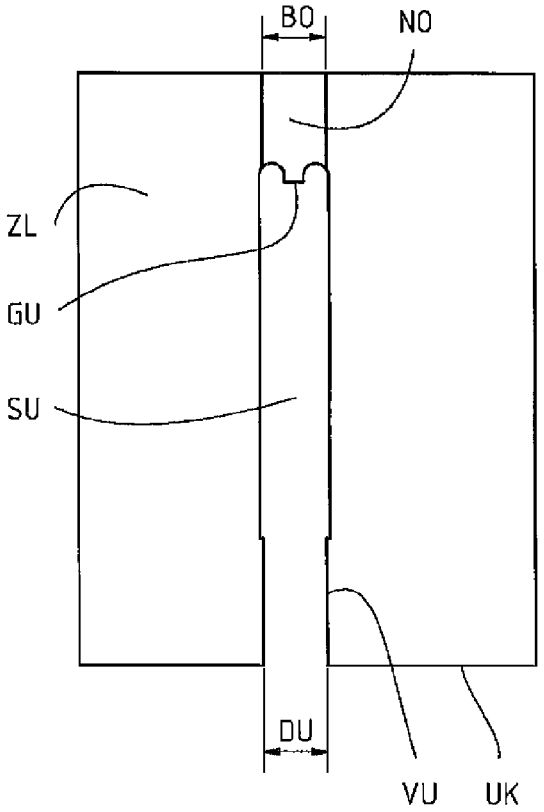
Figure 9:
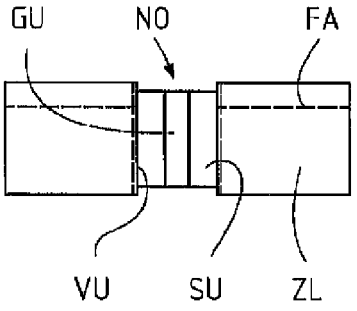

In FIG. 9, a view from below onto the lower slot SU of the longitudinal partition wall panel according to FIG. 8 is shown, from which the opposite upper grooves NO as depressions relative to the wall surface and the lower projections VU that project from the edges of the lower slot, on both sides of the slot center, can be seen. A bevel FA on the top edge of the longitudinal partial wall panel that is covered in this view is indicated with a broken line.

Figure 10:
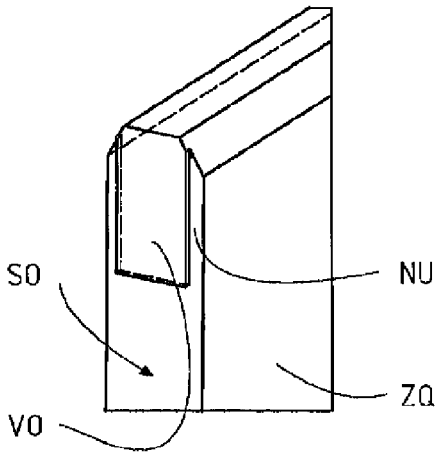

FIG. 10 shows, in a slanted view, a detail of a transverse partition wall panel having an upper slot SO. In this example, too, it is provided that the slot SO is narrowed at the slot opening on the top edge of the transverse partition wall panel, by means of upper projections VO that are directed toward the slot center, and widens again in the direction of the slot bottom, after the upper projections VO, in a region spaced apart from the slot opening. The lower groove NU in the transverse partition wall panel is continued all the way to the upper edge of the latter, so that the upper projections VO do not extend over the entire panel thickness in the y direction, but rather a stepped progression of the edges of the upper slot occurs at this location, in a vertical projection.

Figure 11:
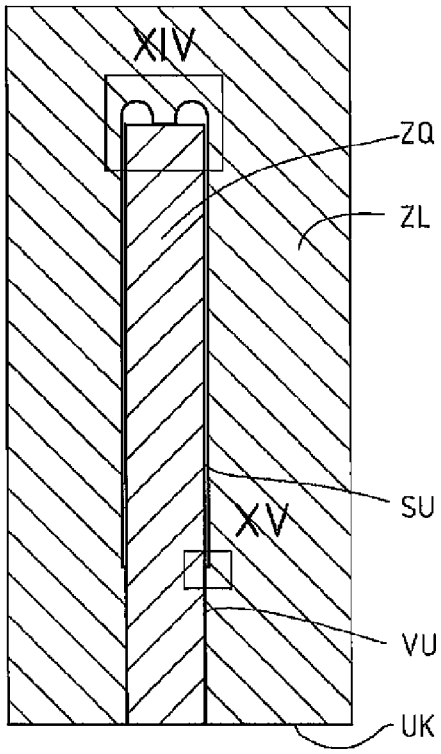

FIG. 11 shows a detail, as a sectional representation in a y-z intersection plane, of an intersection point with a longitudinal partition wall panel ZL and a transverse partition wall panel ZQ that is assembled to it. From the representation according to FIG. 11, it is particularly evident that the distance of the edges of the lower slot SU from the transverse partition wall panel in the y direction is greater in a region spaced apart from the lower slot opening of the lower slot SO than in a region at the lower slot opening, where the edges of the lower slot are configured to project toward the slot center, by way of lower projections VU. This is particularly advantageous for assembly of the wall panels at the intersection point. This is further illustrated in a detail C from FIG. 11 shown in FIG. 15. In the detail shown in FIG. 15, a narrow gap is still indicated between the lower projections VU and the transverse partition wall panel ZQ. However, the lower projections VU can also lie directly against the transverse partition wall panel ZQ in the y direction.

Figure 12:
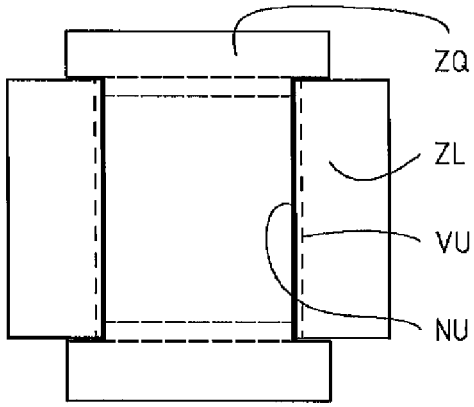

FIG. 12 shows a view of an intersection point from below. From this view, it is evident how the edges of the lower slot SU of the longitudinal partition wall panel ZL engage into the lower groove NU of the transverse partition wall panel ZQ, and how the edges of the slot SU are supported with shape fit on the side edges of the lower groove, in the x direction. Reliable support particularly exists in the region of the lower projections VU, as a result of their deeper engagement into the grooves NU. In FIG. 12, the section plane of the view according to FIG. 11 is indicated with XI-XI, whereby it is evident that the sectional surface shown with cross-hatching in FIG. 11 for the transverse partition wall panel ZQ does not represent the full wall thickness of the transverse partition wall panel ZQ, but rather the wall thickness that is reduced in the region of the lower groove NU.

Figure 13:
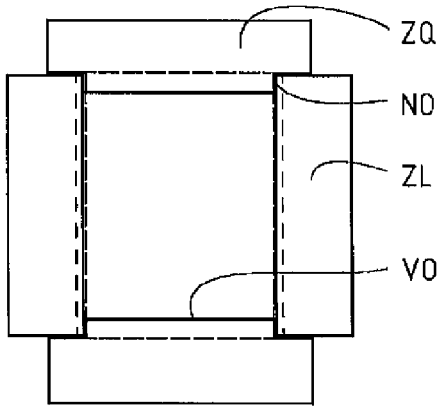

FIG. 13 shows a view vertically from above of an intersection point, and illustrates the stepped progression of the edges of the upper slot SO in this region, with the upper projections VO that do not take up the complete wall thickness of the transverse partition wall panel ZQ. The upper slot SO can be configured to engage into the upper groove NO in a region spaced apart from its slot opening in the direction of the slot bottom, whereby the engagement depth in this distanced region is advantageously less than the engagement depth of the projections VO into the groove NO. However, the upper slot SO can also possess the stepped progression illustrated in FIG. 13 only in the region of the upper projections VO, and be milled out to the complete wall thickness of the longitudinal partition wall panel ZL in a region spaced apart from this in the direction of the slot bottom, so that transverse support of the upper edge of the transverse partition wall panel ZQ in the y direction exists exclusively as a result of the upper projections VO in the upper groove NO.

Transverse support of the edges of the slot in the partition wall panels in the region of the slot opening, in each instance, is particularly advantageous because of the force conditions, but is not compulsory. Transverse support can also be provided over the entire length of the slots, or only starting at a distance from the slot openings, in each instance, in the direction of the slot bottom.

Figure 14:
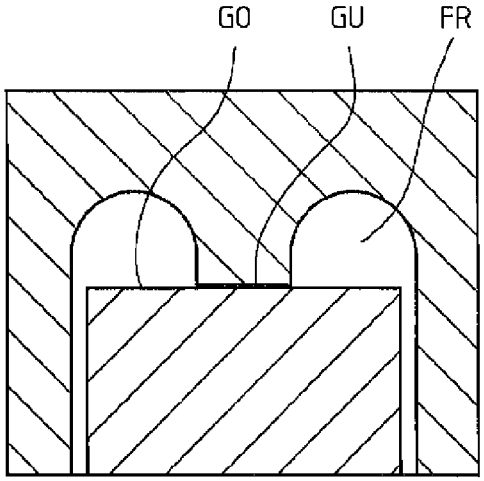
Figure 15:
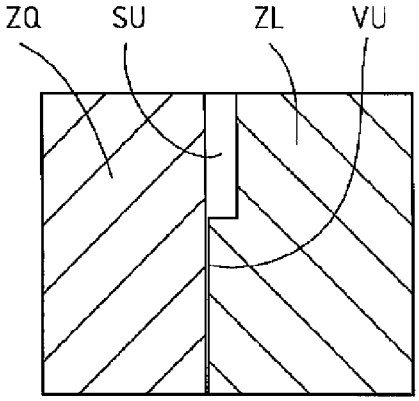

FIG. 14 shows an enlarged detail C from FIG. 11, in which the configuration of the slot bottom of the lower slot SU is shown enlarged. In particular, the side walls of the lower slot SU make a transition, in the region of the slot bottom GU that delimits the insertion depth when longitudinal and transverse partition wall panels are assembled, into the slot bottom, by way of rounded parts FR, thereby reliably avoiding the occurrence of high notch forces in this region. The region of the upper slot SO in the region of its slot bottom GO is advantageously structured in the same manner.

Figure 16:
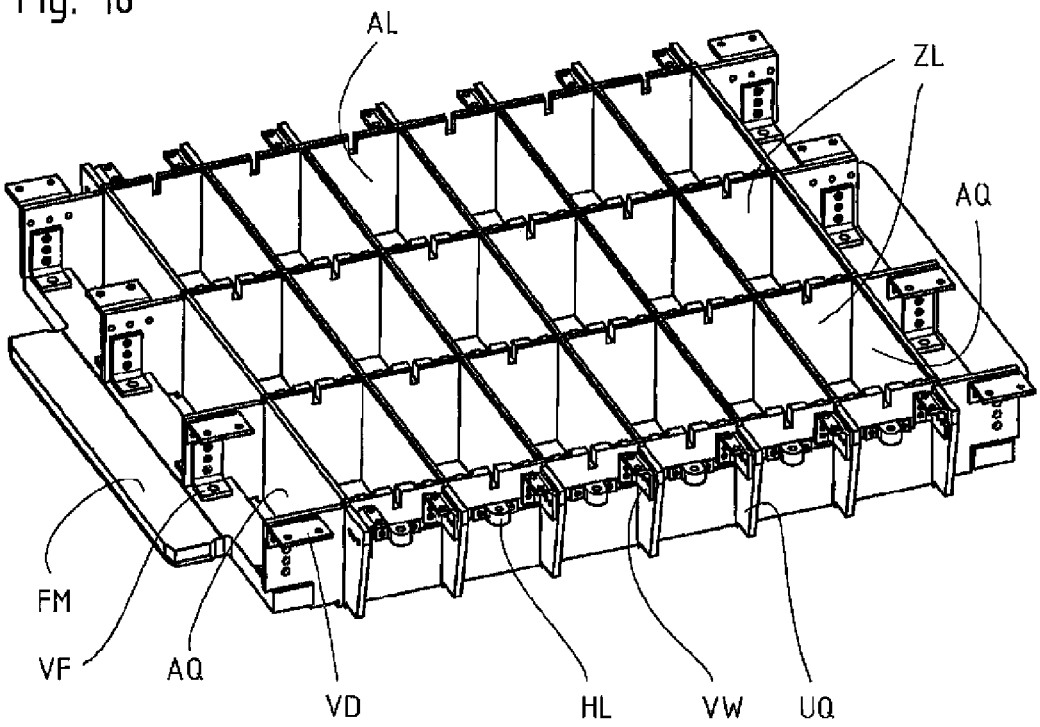
Figure 17:
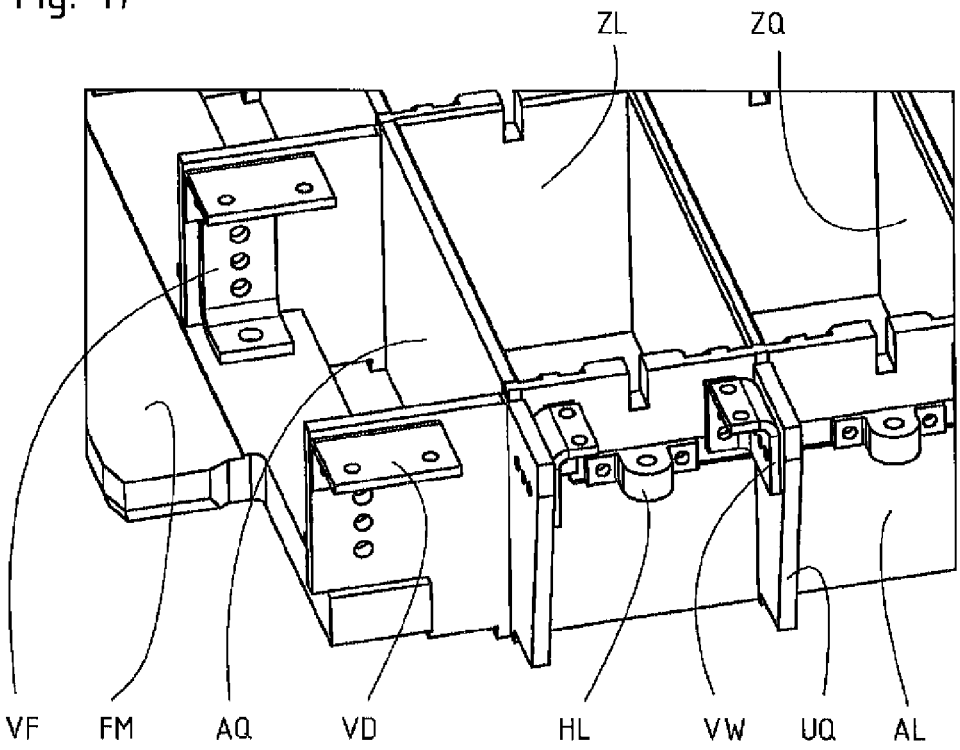

FIG. 16 shows another embodiment of a mold having the connection of longitudinal and transverse partition wall panels according to the invention, whereby in the representation shown in FIG. 16, the metal cover sheets and the core holder arrangement have been left out. FIG. 17 shows an enlarged detail from FIG. 16. In the mold shown in FIG. 16, the transverse partition wall panels that run in the transverse direction x are connected with the longitudinal outside wall panels AL by way of panel sections UQ that project beyond the longitudinal outside wall panels AL, by way of bracket connectors VW. The bracket connectors VW are screwed onto not only the projecting sections UQ but also to the outsides of the outside wall panels AL, by way of two vertical connector shanks. Advantageously, the bracket connectors VW can have an additional horizontal connector shank, as shown, which shank serves to screw the metal cover sheets onto the mold. The panel sections of the transverse outside wall panels AQ that project beyond the outside wall panel AL can be connected with the longitudinal outside wall panels AL with the same bracket connectors. The sections of core holder strips that project beyond the outside wall panels can be braced vertically downward against the outside wall panels by way of additional holding elements HL that are inserted with shape fit into depressions of the outside surface of the outside wall panels AL and are screwed onto the outside wall panels AL.

Further connection brackets VF are provided on the transverse sides of the mold, by means of which the machine flange strips FM are fastened onto the longitudinal partition wall panels and longitudinal outside wall panels. The bracket connectors VF can advantageously be used, at the same time, for screwing the transverse metal cover sheets DQ or DL onto the mold.

The characteristics indicated above and in the claims and evident from the figures can advantageously be implemented both individually and in various combinations. The invention is not restricted to the exemplary embodiments described, but rather can be modified in many different ways, within the scope of the ability of a person skilled in the art.

The invention claimed is:

1. Mold for the production of molded concrete blocks, having multiple molding cavities (FN) that are disposed next to one another and form a block field, which cavities are separated from one another by means of continuous partition walls between the top and the bottom of the mold cavities, wherein the partition walls are formed by partition wall panels (ZL, ZQ) that pass through the entire block field in one piece, and intersect one another at intersection points (KP), wherein two intersecting partition wall panels (ZL, ZQ) are inserted into one another with slots (SU, SO) oriented in opposite directions, wherein holding structures (NU) are configured at least on a first one of the two partition wall panels (ZQ) that intersect at an intersection point, as an extension of the first slot (SO) formed in this first partition wall panel, which structures fix the edges of the second slot (SU) formed in the second of the two partition wall panels (ZL) in place in a direction (y) parallel to the wall surface of the first partition wall panel (ZQ) and transverse to the direction (z) of the first and the second slot, with shape fit, and wherein the holding structures are configured as depressions (NU) relative to the surrounding wall surfaces of the partition wall panels.

2. Mold according to claim 1, wherein the depressions are structured as grooves (NU).

3. Mold according to claim 2, wherein the grooves are structured with side edges perpendicular to the surrounding wall surface.

4. Mold according to claim 2, wherein the groove width is constant and wherein the second partition wall panel lies in the grooves with its entire wall thickness at the edges of the second slot.

5. Mold according to claim 2, wherein the inside surfaces of the second slot have a greater distance from the bottom of the grooves in a section spaced apart from the slot opening than at the slot opening.

6. Mold according to claim 5, wherein the second slot is narrowed at the slot opening as compared with the distanced section.

7. Mold according to claim 1, wherein two holding structures (NO) for transverse support of the edges of the first slot (SO) are formed on the second partition wall panel (ZL).

8. Mold according to claim 1, wherein the first slot and/or the second slot has/have transition gradients of at least 10% of the slot width in the slot bottom that lies opposite the slot opening, toward the slot sides.

9. Mold according to claim 1, wherein the outside walls of the block field are structured as outside wall panels on at least two opposite sides.

10. Mold according to claim 9, wherein the partition wall panels project laterally beyond the block field, intersecting, with projections (UL, ZU).

11. Mold according to claim 8, wherein the block field IS structured to be essentially rectangular, with edges in a longitudinal direction and a transverse direction, and is delimited by two pairs of outside walls oriented at right angles to one another.

12. Mold according to claim 11, wherein the outside wall panels run intersecting one another at corner points.

13. Mold according to claim 10, wherein the projections of the side wall panels are connected with the outside surfaces of the outside wall panels, particularly screwed on, by means of first bracket connectors.

14. Mold according to claim 13, wherein the first bracket connectors only form connections between projections of side wall panels that run in the transverse direction and outside wall panels that run in the longitudinal direction.

15. Mold according to claim 9, wherein the block field is surrounded, on its top surface, by metal cover sheets, and wherein the metal cover sheets are connected with the side wall sheets or the outside wall sheets by way of bracket connectors, particularly screwed on.

16. Mold according to claim 5, wherein at least a part of the second bracket connectors simultaneously forms first connectors.

17. Mold according to claim 9, wherein counter-holders for core holder strips of a mold core arrangement are disposed on the outside surfaces of at least two outside wall panels that lie opposite one another.

18. Mold according to claim 17, wherein the counter-holders are vertically braced with ends of core holder strips that project beyond the outside wall panels.

19. Mold according to claim 17, wherein the counter-holders are screwed onto the outside surfaces of the outside wall panels.

20. Mold according to claim 17, wherein the counter-holders are held on projections of the side wall panels.

21. Mold according to claim 20, wherein the core holder strips lie in recesses of the outside wall panels, and wherein a vertical connection of the outside wall panels with side wall panels that intersect them is combined with bracing of the ends of the core holder strips.

22. Mold according to claim 1, wherein flange arrangements configured for clamping of the mold into a molding machine are provided on two transverse sides that lie opposite one another.

23. Mold according to claim 22, wherein the slots are open toward the bottom in the side wall panels that run between the transverse sides.

24. Mold according to claim 23, wherein the height of the slots that are open toward the bottom amounts to at most 45% of the height of the side wall panels.

25. Mold according to claim 9, wherein additional panels are provided on at least two opposite sides, offset toward the outside from the outside wall panels, which panels form empty fields relative to the outside wall panels.

26. Mold according to claim 25, wherein the additional panels are welded to side wall panels and/or outside wall panels that intersect them.

* * * * *